US012782025B2

(12) United States Patent
Brinkmann et al.

(10) Patent No.: US 12,782,025 B2
(45) Date of Patent: Nov. 3, 2026

(54) METHOD AND SYSTEM FOR CONTROLLING A CONDENSING UNIT

(71) Applicant: ACUITY INTELLIGENT SPACES US INC., Atlanta, GA (US)

(72) Inventors: Doug Brinkmann, Washington, MO (US); John Whitworth, Bixby, OK (US); Mark Reichenbach, Defiance, MO (US)

(73) Assignee: ACUITY INTELLIGENT SPACES US INC., Atlanta, GA (US)

( * ) Notice: Subject to any disclaimer, the term of this patent is extended or adjusted under 35 U.S.C. 154(b) by 123 days.

(21) Appl. No.: 18/864,249

(22) PCT Filed: Jul. 31, 2024

(86) PCT No.: PCT/US2024/040290
§ 371 (c)(1),
(2) Date: Nov. 8, 2024

(87) PCT Pub. No.: WO2025/029864
PCT Pub. Date: Feb. 6, 2025

(65) Prior Publication Data

US 2026/0153277 A1 Jun. 4, 2026

Related U.S. Application Data

(60) Provisional application No. 63/529,877, filed on Jul. 31, 2023.

(51) Int. Cl.
*F25B 49/02* (2006.01)

(52) U.S. Cl.
CPC ..... *F25B 49/027* (2013.01); *F25B 2500/31* (2013.01); *F25B 2700/1933* (2013.01)

(58) Field of Classification Search
CPC ..... F25B 49/027; F25B 2500/31; F25B 2700/1933
See application file for complete search history.

(56) References Cited

U.S. PATENT DOCUMENTS 4,537,038 A 8/1985 Alsenz et al.
4,974,420 A 12/1990 Kramer
(Continued)

FOREIGN PATENT DOCUMENTS

CN 112728821 A * 4/2021 ..... F25B 49/022
CN 113405245 A * 9/2021 ..... F24F 11/64
(Continued)

OTHER PUBLICATIONS

Notification of Transmittal of the International Search Report (PCT/ISA/210) and the Written Opinion (PCT/ISA/237) mailed Jan. 15, 2025, in corresponding International Application No. PCT/US2024/040290. (15 pages).

*Primary Examiner* — Kun Kai Ma
(74) *Attorney, Agent, or Firm* — Sikand IP Law PLLC

(57) ABSTRACT

The present disclosure relates to a method and system for controlling a condensing unit operating, for example, in low ambient temperature conditions or a startup sequence for a refrigeration system. The method and system verify if a suction pressure of a compressor of the condensing unit is below a Low Ambient Safety Pressure (LASP) value, and if the suction pressure is below the LASP, the method and system execute a below LASP sub-module. The method and system further verify whether the suction pressure of the compressor of the condensing unit is above the LASP but below a Low Pressure Cut Out (LPCO), and if the suction pressure is above the LASP and below the LPCO, executing a below LPCO sub-module.

11 Claims, 13 Drawing Sheets

(56) References Cited

U.S. PATENT DOCUMENTS

| | | | |
|---|---|---|---|
| 5,152,151 | A | 10/1992 | Jarosch |
| 2011/0083450 | A1 | 4/2011 | Turner et al. |
| 2018/0224175 | A1 | 8/2018 | Crawford et al. |

FOREIGN PATENT DOCUMENTS

| | | | | | |
|---|---|---|---|---|---|
| CN | 113418326 | A | * | 9/2021 | ..... F25B 49/022 |
| CN | 114322371 | A | * | 4/2022 | |
| CN | 116007193 | A | * | 4/2023 | |
| KR | 102469645 | B1 | * | 11/2022 | ..... F25B 49/02 |

* cited by examiner

METHOD AND SYSTEM FOR CONTROLLING A CONDENSING UNIT

CROSS-REFERENCE TO RELATED APPLICATIONS

This application is a U.S. National Phase Application of International Application No. PCT/US2024/040290 filed on Jul. 31, 2024, titled "Method and System for Controlling a Condensing Unit." the entirety of which is incorporated by reference herein. International Application No. PCT/US2024/040290 claims priority to U.S. Provisional Patent Application No. 63/529,877, filed on Jul. 31, 2023, titled "Method and System for Controlling a Condensing Unit Operating in Low Ambient Conditions," the entire disclosure of which is incorporated by reference herein.

TECHNICAL FIELD

The present disclosure relates to the field of refrigeration, and more precisely to methods and systems for operating, for example, in low ambient temperatures or a startup sequence for a refrigeration system.

BACKGROUND

Refrigeration systems must operate over a very wide range of ambient temperatures. From heat waves to freezing spells, it is challenging to design and operate a refrigeration system under such wide ambient temperature variations.

Problems arise when the refrigeration system must start cooling after a period of inactivity in low ambient temperatures. The low ambient temperatures impact the temperature and pressure of the refrigerant, which render a flow of refrigerant in a refrigeration cycle more difficult.

One of the main problems arise when a compressor in the condensing unit of the refrigeration system is unable to circulate the refrigerant in the system sufficiently and quickly enough to maintain a minimum pressure on the low side of the system at the beginning of a refrigeration run cycle. Without maintaining this minimum pressure, the compressor shuts off prematurely which causes a disruption of the refrigeration cycle, prolongs time to satisfy space conditions and creates unnecessary starts and stops of the compressor, resulting in reduced service life.

There is therefore a need for a new method and system which addresses the shortcomings of current refrigeration systems when operating at low ambient temperatures.

SUMMARY

According to a first aspect, the present disclosure relates to a method for controlling a condensing unit operating in low ambient temperature conditions. The method comprises verifying by a controller of the condensing unit if a suction pressure of a compressor of the condensing unit is below a Low Ambient Safety Pressure (LASP) value, and if the suction pressure is below the LASP, the controller executes a below LASP sub-module. The method further verifies by the controller of the condensing unit whether the suction pressure of the compressor of the condensing unit is above the LASP but below a Low Pressure Cut Out (LPCO), and if the suction pressure is above the LASP and below the LPCO, the controller executes a below LPCO sub-module.

According to a second aspect, the present disclosure relates to a system for controlling operation of a condensing unit in low ambient temperature conditions. The system comprises an input port for receiving a current suction pressure value at an input of a compressor of the condensing unit. The system further comprises a controller for verifying if a suction pressure of a compressor of the condensing unit is below a Low Ambient Safety Pressure (LASP) value, and if the suction pressure is below the LASP, the controller executes a below LASP sub-module. The controller further verifies whether the suction pressure of the compressor of the condensing unit is above the LASP but below a Low Pressure Cut Out (LPCO), and if the suction pressure is above the LASP and below the LPCO, the controller executes a below LPCO sub-module.

The method and systems disclosed herein can be applied for a singular or combination of causes: low room temperature setpoint, improper cut-in/cut-out setpoints on the low-pressure control, lower saturated temperatures/pressures with newer refrigerants. Where low pressure controls are set correctly, it may lead to compressor short cycling. To address short cycling, OEMs add delays to the compressors which create delays in cooling, generate alarms, and can result in cyclical failure between the evaporator and condensing unit where electric expansion valves are used.

BRIEF DESCRIPTION OF THE DRAWINGS

Embodiments of the disclosure will be described by way of example only with reference to the accompanying drawings, in which.

DETAILED DESCRIPTION

The foregoing and other features will become more apparent upon reading of the following non-restrictive description of illustrative embodiments thereof, given by way of example only with reference to the accompanying drawings. Like numerals represent like features on the various drawings.

Various aspects of the present disclosure generally address starting of units of a refrigeration system in low ambient temperatures.

The following terminology is used throughout the present disclosure:

Low ambient temperature: refers to an ambient temperature where a condensing unit is located, ambient temperature which is colder than the evaporator temperature.

Low Pressure Cut Out: refers to a minimal suction pressure setting for operating a compressor of a condensing unit.

Figure 1:
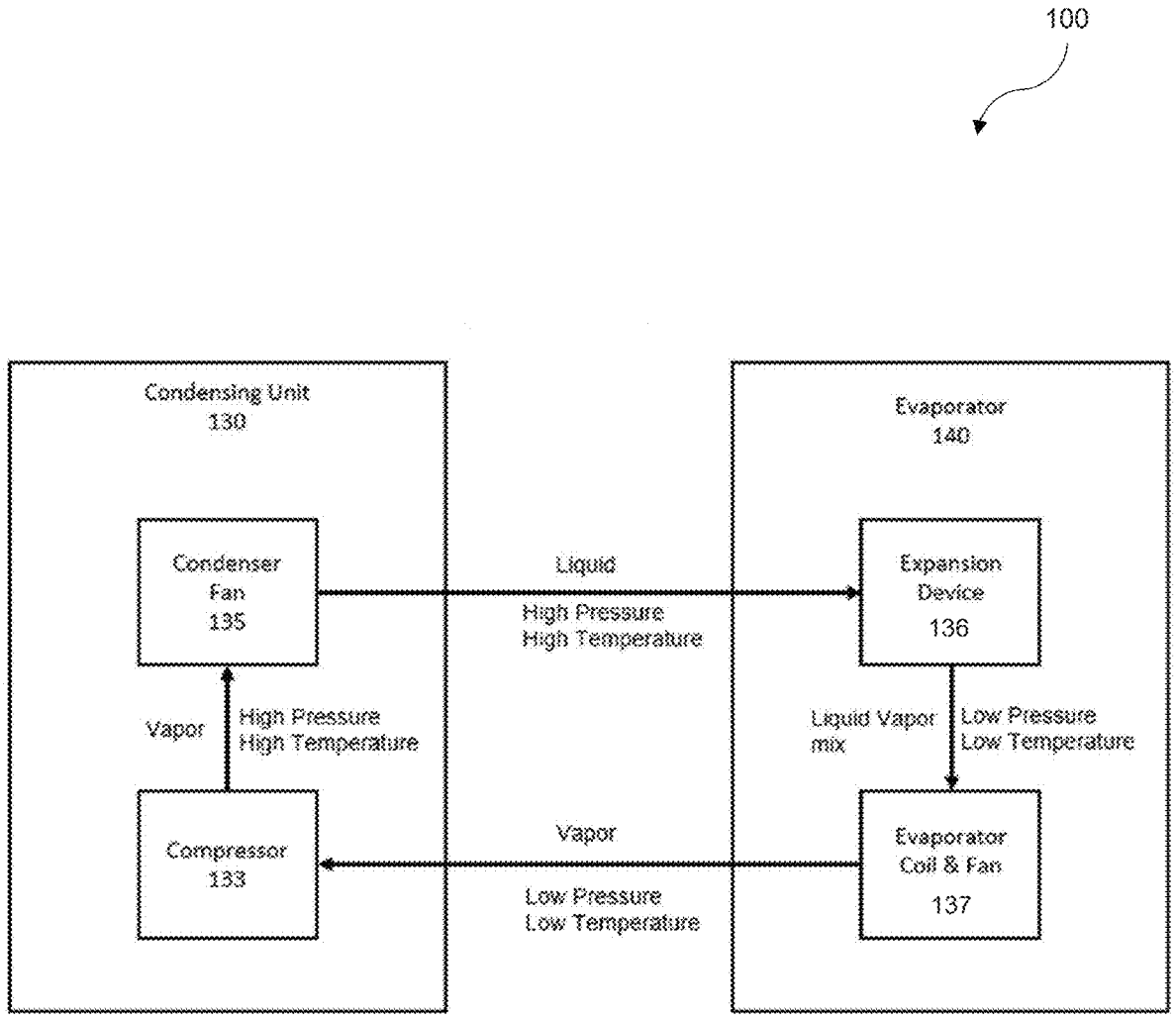
FIG. 1 illustrates an exemplary refrigeration system and a refrigeration cycle.

FIG. 1 depicts a refrigeration cycle performed by a refrigeration system 100. FIG. 1 is a simplified example of the refrigeration system 100, and more particularly of the components of the refrigeration system 100 and interactions therebetween in the context of the refrigeration cycle. The refrigeration cycle of the refrigeration system 100 can be a closed loop cycle. In its simplest implementation, the refrigeration system 100 comprises a condensing unit 130 and an evaporator unit 140. A refrigerant is circulated through the refrigeration system 100. The refrigerant enters the condensing unit 130 in vapor form at a low temperature and low pressure. The refrigerant is discharged by a compressor 133 of the condensing unit 130 in gas form at a high temperature and a high pressure. The refrigerant enters a condenser coil and fan 135 in gas form at high temperature and high pressure. The refrigerant is discharged by the condenser coil and fan 135 in liquid form at a high temperature and high pressure. The refrigerant enters the evaporator 140 in liquid form at a high temperature and high pressure and exits the expansion device 136 in liquid and vapor mix at a low temperature and a low pressure and then into an evaporator coil and fan 137. The evaporator 140 can include a controller or be controlled by a sensor, communications point, or other input.

Figure 2:
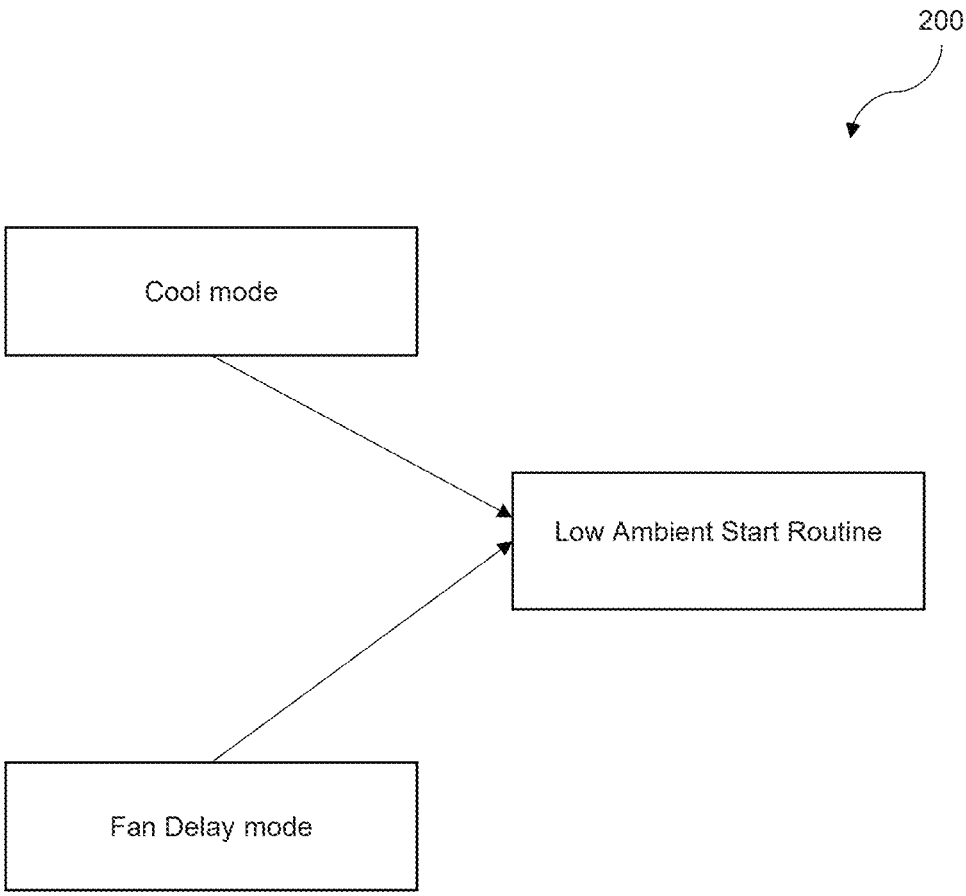
FIG. 2 illustrates four exemplary modes of the refrigeration cycle which can trigger one or several modules of a Low Pressure Cut Out with Low Ambient Start Function (LPCO-LASF)

In operation, the condensing unit 130 progresses as a sequence of modes, where each mode executes one or several routines depending on the conditions. In the context of the present invention, modules are introduced to support modes of the condensing unit 130 in low ambient temperatures, and more particularly to perform Low Pressure Cut Out in Low Ambient Start Function (LPCOASF). The present LPCOLASF may be executed by a controller at the condensing unit 130 or remotely located. The LPCOLASF is structured as a subset of Modules, where each Module corresponds to new steps to be performed by the condensing unit 130 when operating in low ambient temperatures. For clarity purposes, the modules of the LPCOLASF are herein illustrated and described on a per mode basis. Modules of the LPCOLASF are executed when in low ambient temperatures in the two modes of operation of the condensing unit 130 illustrated in FIG. 2, namely the Cool mode and the Fan Delay mode. These two modes are well known in the refrigeration industry and will not be described herein per se, only the additions introduced by the LPCOLASF to these two modes will be described and illustrated.

Figure 3:
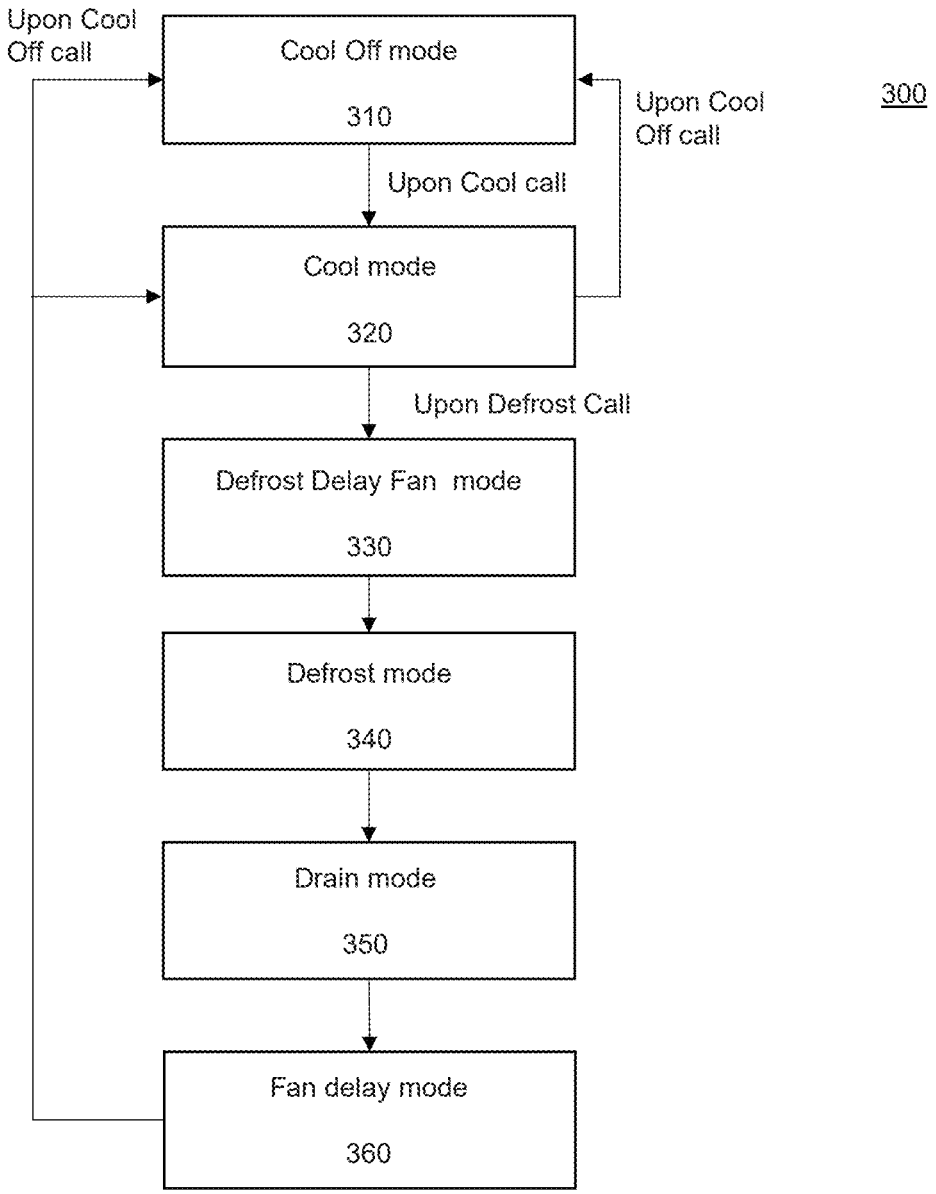
FIG. 3 illustrates an exemplary sequence of modes of operation of the refrigeration system 100.

FIG. 3 illustrates an exemplary simplified sequence 300 of modes executed when operating the condensing unit 130. The illustrated sequence 300 starts with a Cool Off mode 310 in which the condensing unit 130 is electrified, but not presently operating. Thus, in the Cool Off mode 310, the condensing unit 130 is not condensing. When a request is received at the condensing unit 130 for initiating cooling by another controller (not shown) or a thermostat (not shown), the condensing unit 130 enters into Cool mode 320. The condensing unit 130 verifies whether a subset of operating conditions is met before changing to the Cool Mode 320. The Cool Off mode 310 is one of the modes where a module of the present LPCOLASF is executed. The various modules of the LPCOLASF will be discussed further. The Cool mode 320 is the mode in which the condensing unit 130 proceeds with condensing the refrigerant received. If the condensing unit 130 does not perform as expected and/or cannot meet predefined set points for the Cool mode 320, or receives a Defrost call, the condensing unit 130 starts execution a Delay Defrost Fan Mode 330. When the Delay Defrost Fan Mode 330 meets predetermined conditions or ends, the condensing unit 130 then transitions into Defrost mode 340. The Defrost mode 340 is another mode which executes a module of the LPCOLASF. The Defrost mode 340 is typically followed by a Drain mode 350, which may be followed by a Fan Delay mode 360. After the Fan Delay mode 360 is completed, the condensing unit 130 continues with the Cool mode 320 unless a Cool off call is received (e.g., a request from the refrigeration system 100 or another controller (not shown) or a thermostat (not shown) to stop cooling.

Figure 4:
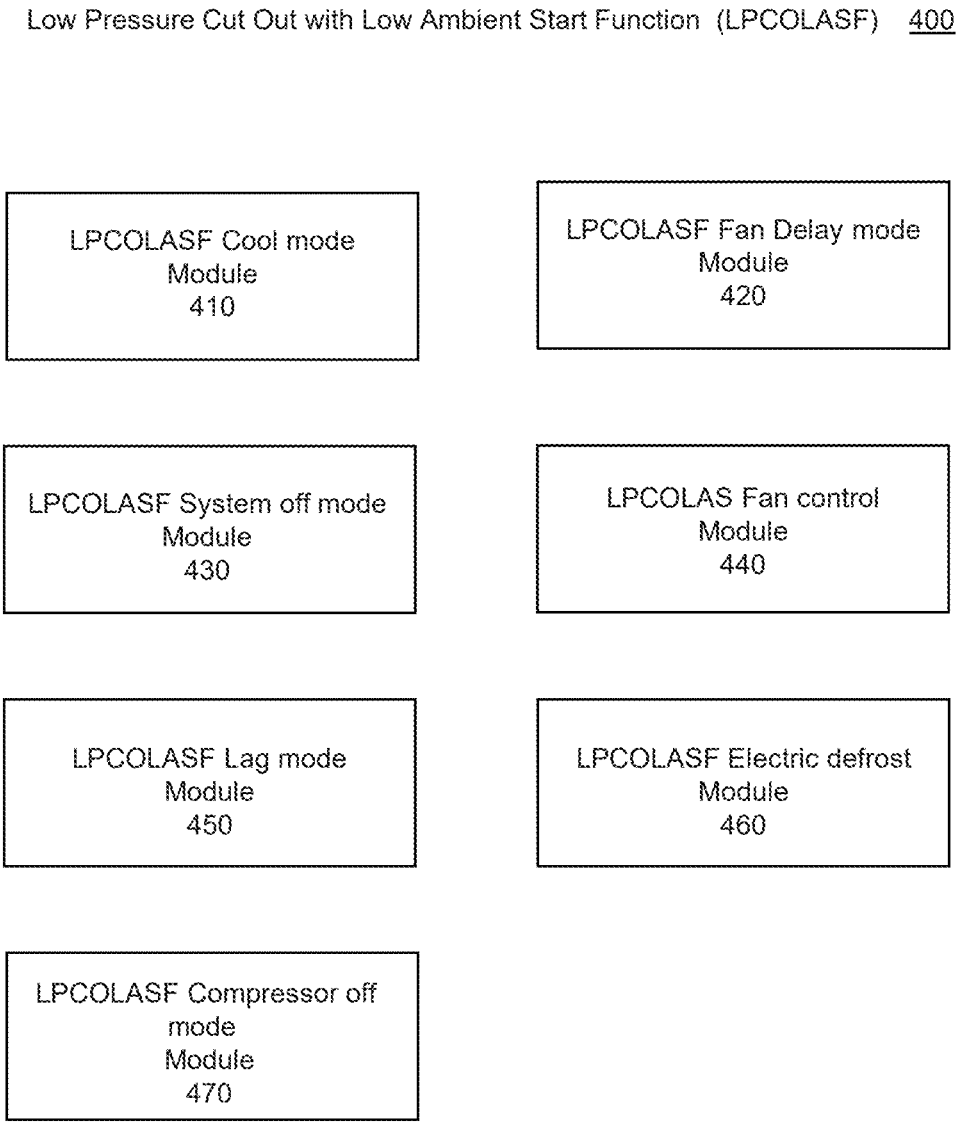
FIG. 4 illustrates modules of the LPCOLASF 400.

Reference is now made to FIG. 4 which illustrates the various modules of the LPCOLASF 400. The LPCOLASF may be divided into the following modules: a LPCOLASF Cool mode Module 410, a LPCOLASF Fan Delay mode Module 420, a LPCOLASF System off mode Module 430, a LPCOLASF Fan control Module 440, a LPCOLASF Lag mode Module 450, a LPCOLASF Electric defrost Module 460 and a LPCOLASF Compressing unit off mode Module 460. Each of these Modules will be discussed and illustrated separately for simplicity purposes. However, those skilled in the art will understand that subsets of those Modules could be executed in parallel or in sequence, depending on the conditions of the condensing unit 130 and the ambient temperature at the condensing unit 130.

The LPCOLASF 400 uses two parameters and set points of the condensing unit 130. The first parameter used by the LPCOLASF 400 is a Low Pressure Cut Out (LPCO) value. The LPCO value refers to a minimum input pressure value (also referred as suction pressure value) for the refrigerant at the compressor 133 of the condensing unit 130. The second parameter used by the LPCOLASF 400 is a Low-Pressure Differential (LPD) which is added to the LPCO value to determine a normal activation suction pressure of the compressor 133.

Furthermore, the LPCOLASF 400 introduces three new parameters: a Max Time for reaching the LPCO value, a number of Attempts to pump down unit, and a Low Ambient Safety Pressure value (LASP). The Max Time for reaching the LPCO value may for example be between 0-15 minutes (or approximately 0-15 minutes), with a default value set at 2 minutes (or approximately 2 minutes) and be manually changed. The number of Attempts to pump down unit may range for example between 1-7 times (or approximately between 1-7 times), with a default value set at 2 (or approximately 2). The Low Ambient Safety Pressure (LASP) value is a new set point introduced to allow safe operation of the condensing unit 130 when executing the present LPCOLASF 400. The LASP value is set lower than the LPCO value, to allow reactivation of the condensing unit 130 in low ambient temperatures.

Figure 5A:
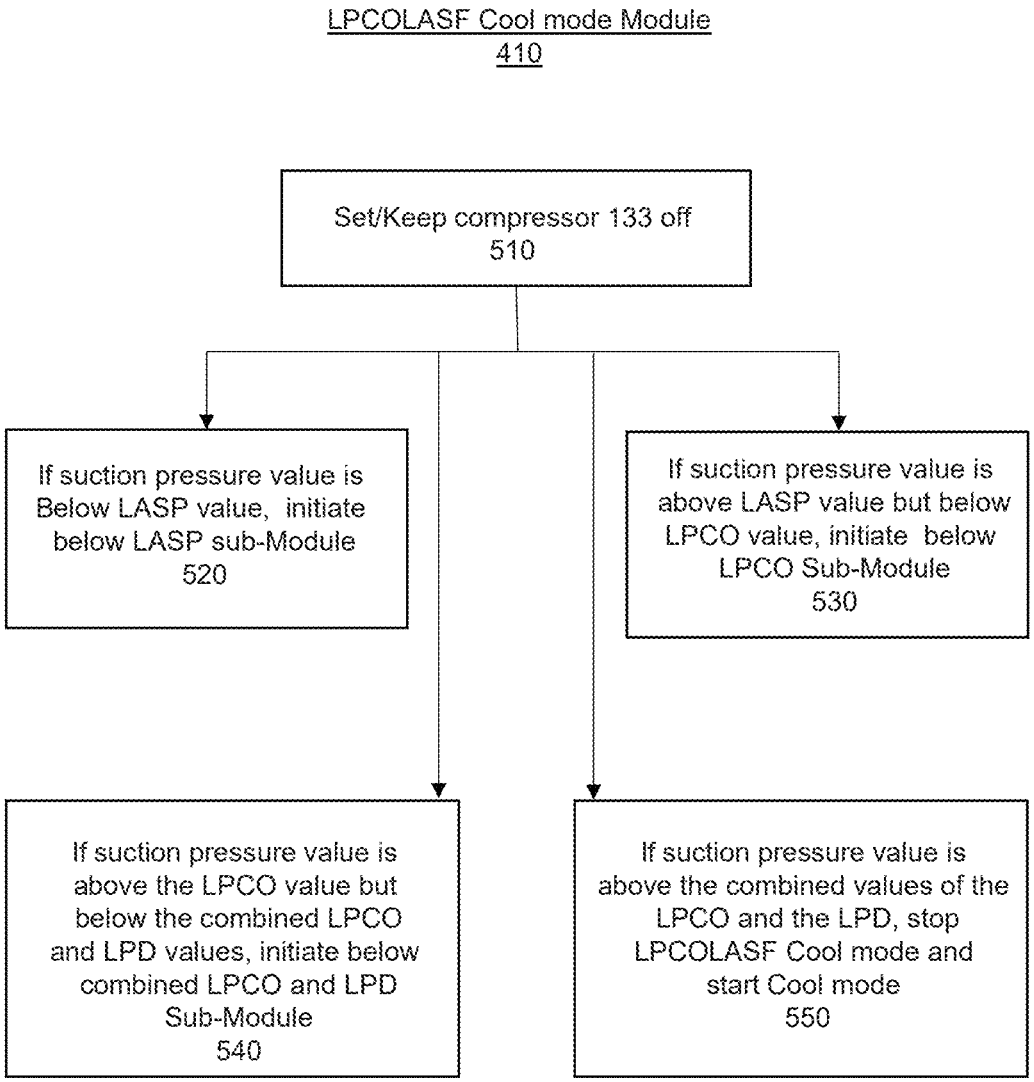
FIGS. 5A-5D illustrate a method implementing the Cool mode Module 410 of the LPCOLASF 400.

Reference is now made to FIG. 5A which illustrates a method implementing the Cool mode Module 410 of the LPCOLASF 400.

The method implementing the LPCOLASF Cool mode Module 410 starts with setting or keeping (step 510) the compressor 133 of the condensing unit 130 deactivated or in an 'off' state. If the suction pressure value of the compressor 133 of the condensing unit 130 is below the LASP value, a below LASP sub-module is initiated (step 520). If the suction pressure value of the compressor 133 of the condensing unit 130 is above the LASP value, but below the LPCO value, a below LPCO sub-module is initiated (step 530). If the suction pressure value of the compressor 133 of the condensing unit 130 is above the LASP value and the LPCO value, but below a combined LPCO and LPD values, a below combined LPCO and LPD sub-module is initiated (step 540). Finally, if the suction pressure value of the compressor 133 of the condensing unit 130 is above the LASP and the combined values of LPCO and LPD, the condensing unit 130 transitions to a cool mode (step 550), and the LPCOLASF cool mode module 410 continues running for 2 minutes (or approximately 2 minutes) before ending.

Figure 5B:
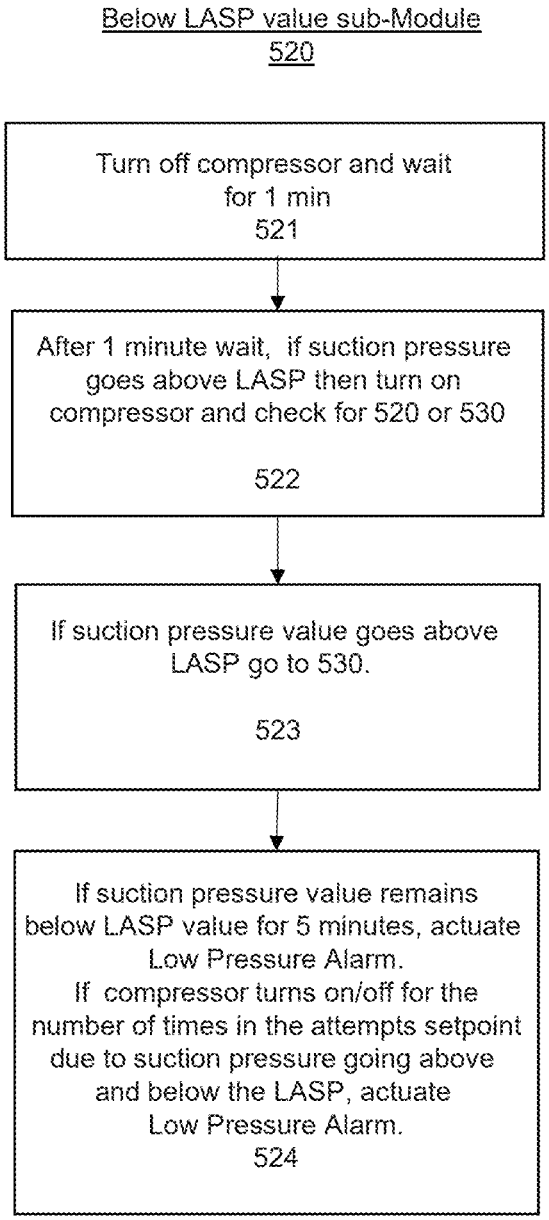

FIG. 5B illustrates the below LASP sub-Module 520. The method implementing the below LASP sub-Module 520 starts by waiting for 1 minute (or approximately 1 minute). After 1 minute (or approximately 1 minute), if the suction pressure value goes above the LASP value, the below LASP sub-module is ended and the Below LPCO sub-module is initiated (step 522). If after 5 minutes (or approximately 5 minutes) the suction pressure value remains below the LASP value, a Low-Pressure Alarm is actuated, and the condensing unit 130 is shut off (step 524).

Figure 5C:
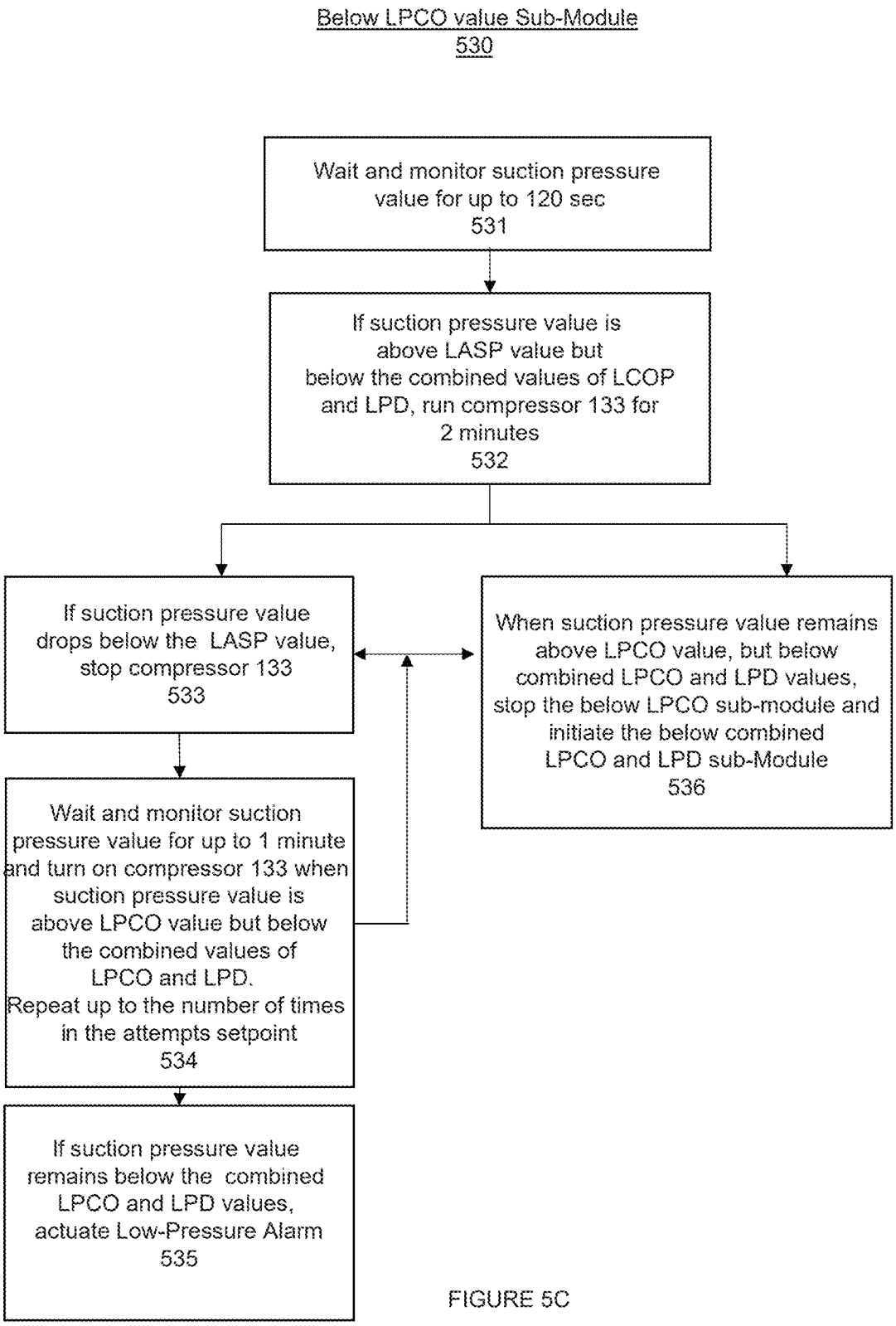
Figure 5D:
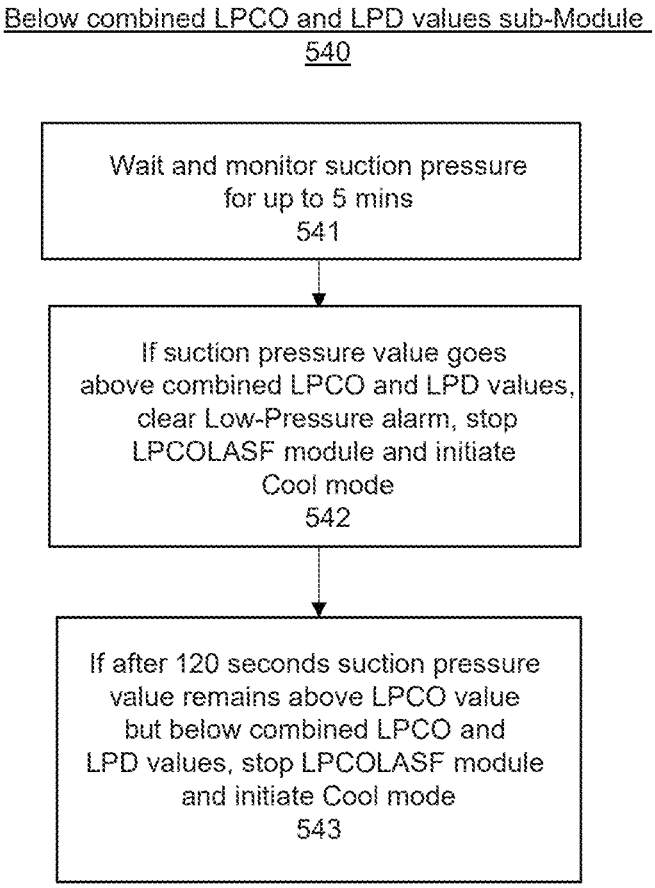

FIG. 5C illustrates the below LPCO sub-Module 530. The method implementing the below LPCO sub-Module 530 starts by waiting and monitoring the suction pressure value of the compressor 133 of the condensing unit 130 for up to 120 seconds or approximately 120 seconds (step 531). The method continues with monitoring if the suction pressure value is maintained above the LASP value but is below the combined values of LPCO and LPD, and when the condition is met, the compressor 133 of the condensing unit 130 is actuated for 2 minutes or approximately 2 minutes (step 532). After the 2 minutes (or approximately 2 minutes) of actuation, the Below LPCO sub-module 530 continues with monitoring the suction pressure value at the input of the compressor 133 of the condensing unit 130, and if the suction pressure value drops below the LASP value, the compressor 133 of the condensing unit 130 is stopped (step 533). The suction pressure value is then monitored for up to 1 minute (or approximately 1 minute) and the compressor 133 is reactivated if the suction pressure value is above the LPCO value but below the combined LPCO and LPD values (step 534). Step 534 may be repeated up to a number of times corresponding to an attempts setpoint if the suction pressure value is still below the LPCO value. If after those iterations the suction pressure value remains below the LPCO value, a Low-Pressure Alarm is actuated (step 535). When the suction pressure value remains above LPCO value but below the combined LPCO and LPD values (step 536), the method continues by stopping the below LPCO sub-module 530 and initiating the combined LPCO and LPD sub-module 540.

FIG. 5 D illustrates the below combined LCOP and LPD values sub-Module 540. The method implementing the below combined LCOP and LPD values sub-Module 540 starts by waiting and monitoring the suction pressure value of the compressor 133 of the condensing unit 130 for up to 5 mins (step 541). If the suction pressure value goes above the combined LPCO and LPD values, the method clears the Low-Pressure alarm, stops the LPCOLASF 400 after two minutes (or approximately 2 minutes) and initiate the Cool mode (step 542). If after 120 seconds (or approximately 120 seconds) the suction pressure value of the compressor 133 of the condensing unit 130 remains above the LPCO value but below the combined LPCO and LPD values, the method stops the LPCOLASF 400 and initiates the Cool mode known (step 543).

The method illustrated on FIGS. 5A-5D is also applicable to the LPCOLASF Fan Delay Mode Module 420 which is to be executed before initiating the regular Fan Delay Mode as known in the art. In the case of the Fan Delay Mode, the expressions 'Cool mode' through FIGS. 5A-5D is replaced by 'Fan Delay mode', but the sequence of steps and set-points are the same.

Figure 6:
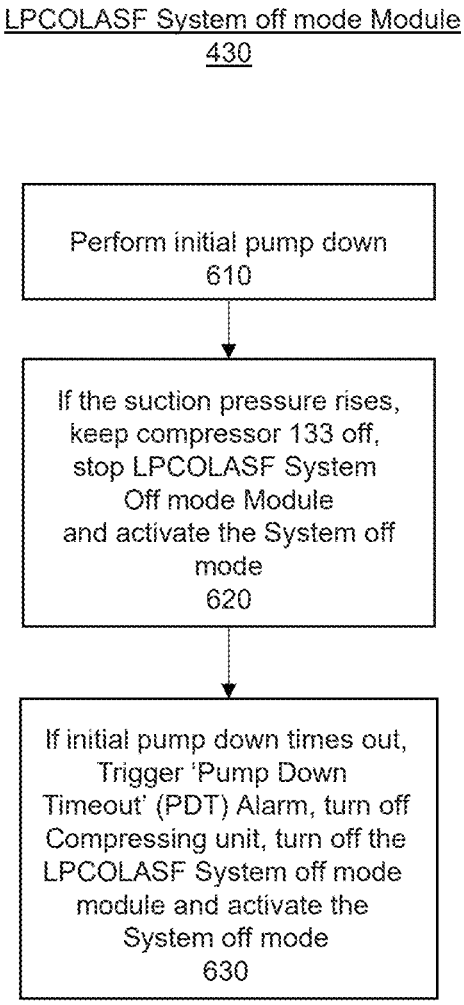
FIG. 6 illustrates a method implementing the System off mode Module 430 of the LPCOLASF 400.

FIG. 6 illustrates steps of the LPCOLASF System off mode Module 430. The method implementing the System off mode Module 430 starts by performing an initial pump down (step 610). Initial pump down consists of closing a refrigerant line solenoid and/or electric expansion valve at the evaporator 140 and continuing to pump refrigerant from the suction side by running the compressor 133 until the suction pressure reaches the LPCO setpoint, at which point the compressor 133 turns off. More particularly, the expression 'initial pump down' refers to a first pump down when entering system off mode. Sometimes the pressure rises while the system is off and the compressor 133 comes on for a short period to bring the pressure back down, but the controller does not do this in system off mode. The method continues with verifying whether the suction pressure at the input of the compressor 133 of the condensing unit 130 rises, and if the suction pressure rises, the compressor 133 is kept off, the LPCOLASF System off mode Module 430 is stopped and the system off mode is activated (step 620). However, if the initial pump down times out and the suction pressure at the input of the compressor 133 of the condensing unit 130 has not decreased below the LPCO value, the method triggers a 'Pump Down Timeout' (PDT) Alarm, turns off the compressor 133, turns off the LPCOLASF System off mode Module 430 and activates the system off mode (step 630). The method illustrated on FIG. 6 for implementing the LPCOLASF System off mode Module 430 also applies to the LPCOLASF Lag mode Module 450.

Figure 7:
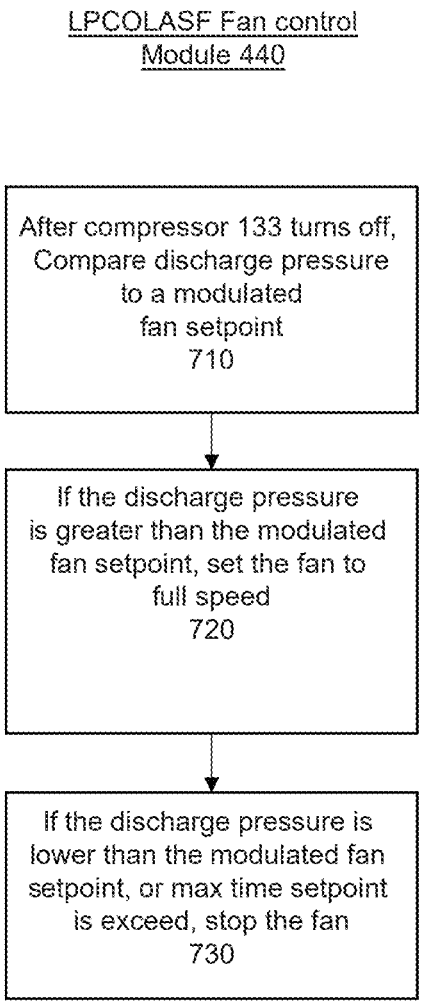
FIG. 7 illustrates a method implementing the Fan control Module 440 of the LPCOLASF 400.

FIG. 7 illustrates a method implementing the LPCOLASF Fan control Module 440. The method implementing the LPCOLASF Fan control Module 440 starts when compressor is turned off by comparing 710 the discharge pressure at the output of the compressor 133 of the condensing unit 130 to a modulated fan setpoint. In a particular embodiment, the modulated fan setpoint corresponds to a Condensing Fan Cut Out value to which is added ½ a Condensing Fan Pressure Difference value. The Condensing Fan Cut Out value corresponds to a discharge pressure set point of the condensing unit 130 to turn off the fan 135. The Condensing Fan Pressure Difference value corresponds to a pressure difference above the Condensing Fan Cut Out to turn the fan 135 of the condensing unit 130 off. If the value of the discharge pressure of the compressor 133 is greater than the modulated fan setpoint, step 720 sets the fan 135 to full speed. If the value of the discharge pressure of the compressor 133 is lower than the modulated fan value or time running since compressor 133 turned off exceeds Max Fan Time on When Comp Off setpoint, step 730 stops the fan 135.

Figure 8:
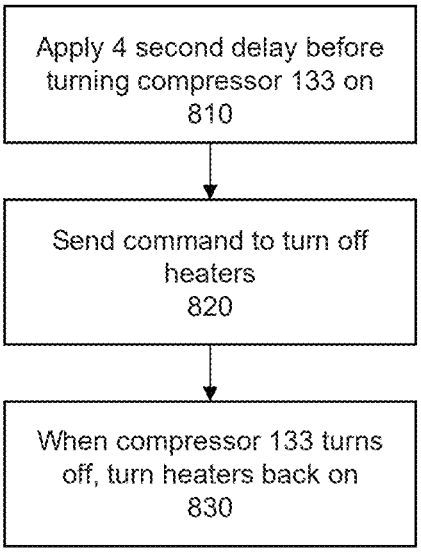
FIG. 8 illustrates a method implementing the Electric defrost Module 460 of the LPCOLASF 400.

FIG. 8 illustrates a method implementing the Electric defrost Module 460 of the LPCOLASF 400. The method starts with applying a 4 second delay (or approximately 4 second delay) before turning compressor 133 on (step 810). The method pursues with sending a command to turn off heaters of the evaporation unit 140 (not shown) (step 820). The method terminates when the compressor 133 is turned off and the method sends a second command to the heaters to turn back on (step 830).

Figure 9:
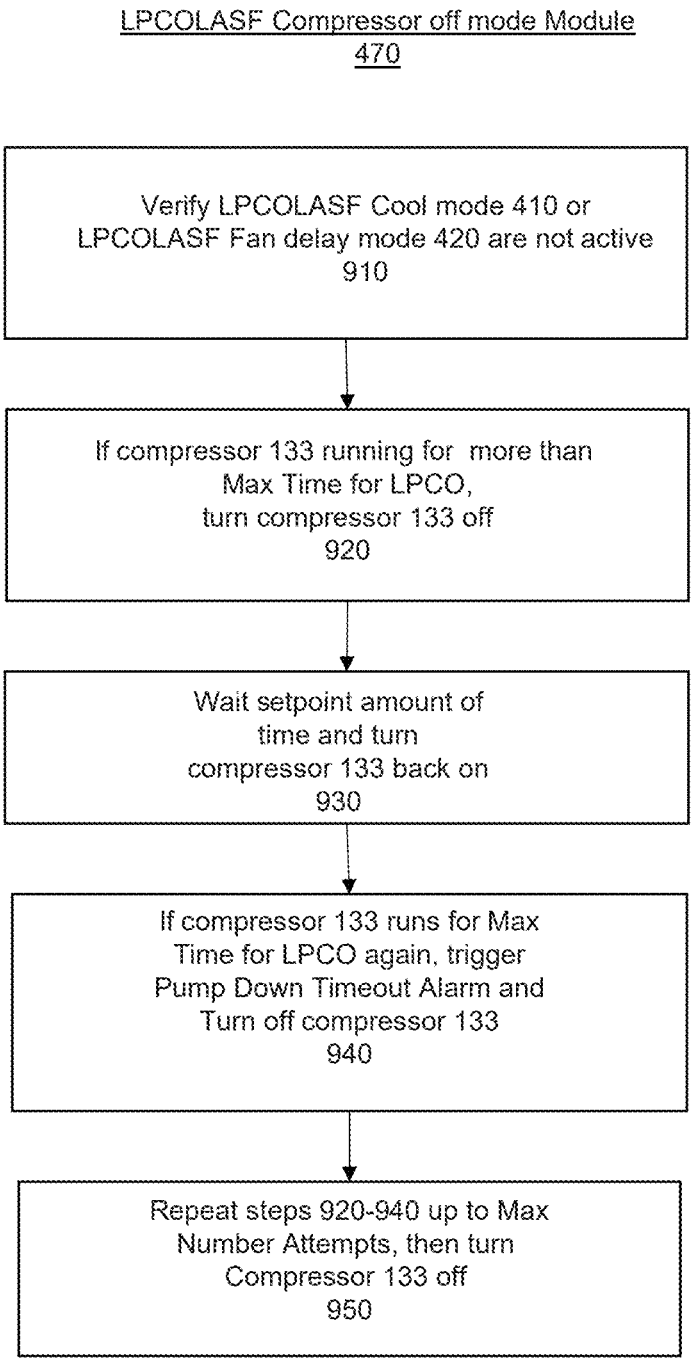
FIG. 9 illustrates a method implementing the Compressor Off mode Module 470 of the LPCOLASF 400.

FIG. 9 illustrates a method implementing the Compressor Off mode Module 470 of the LPCOLASF 400. The method starts with verifying that LPCOLASF Cool mode 410 or LPCOLASF Fan Delay 420 are not active at step 910. The method continues by verifying whether the compressor 133 has been running for more than a predetermined time labeled as Max Time for LPCO, and if the compressor 133 has been running for more Max Time for LPCO, the compressor is turned off at step 920. In step 930, the method can then wait a specified setpoint amount of time within the range of minutes (e.g., user specified or programmed), for example within a predetermined limit. The setpoint can be programmed between 0-15 minutes with a default of 1 minute. For example, the setpoint of minutes to wait can be up to 15 minutes (or up to approximately 15 minutes), up to 1 minute (or up to approximately 1 minute), or up to 5 minutes (or up to approximately 5 minutes). In step 930, after waiting the setpoint amount of time, the method turns the compressor 133 back on at step 930. The method continues with step 940 where a verification is made to determine whether the compressor 133 runs for Max Time for LPCO again, and in the positive, a Pump Down Timeout Alarm is triggered and the compressor 133 is turned off again. The method continues at step 950 where steps 920-940 may be repeated up to a Max Number Attempts (a predetermined value), then the compressor 133 is turned off and the LPCOLASF Compressor off mode Module 470 is ended.

Figure 10:
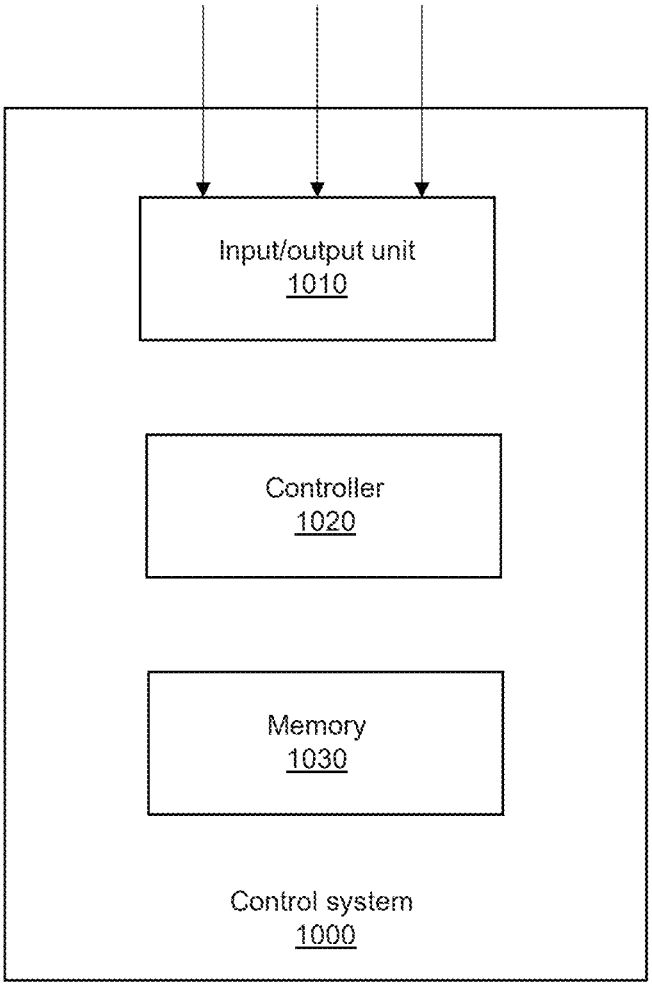
FIG. 10 illustrates a system executing the LPCOLASF 400.

Reference is now concurrently made to FIGS. 4-10, where FIG. 10 schematically illustrates components of a Condenser control system 1000 for executing the LPCOLASF 400 for controlling operation of the condensing unit 130 in low ambient temperature conditions. The Control system 1000 may be co-located with the condensing unit 130, the expansion unit 140 or be separately located therefrom. The Control system 1000 comprises an input/output unit 1010, a controller 1020 and a memory 1030. The input/output unit 1010 may be adapted for receiving wired or wireless messages and signals. For example, the input/output unit 1010 may be adapted for wirelessly communicating (using any known wireless protocol such as BLUETOOTH®, WiFi, LTE, 5G, or any other wireless protocol) or communicating through wires using any of the known standards in the industry (such as for example ModBus, etc.) with one of several of the following components: the condensing unit 130, the expansion unit 140, the evaporating unit 150, another controller or a thermostat (not shown), etc. The input/output unit 1010 is adapted for receiving a cooling request from another controller (not shown), thermostat (not shown) or any other electronic device in wired or wireless communication. The input/output unit 1010 is further adapted for receiving, directly or indirectly, a suction pressure value at the inlet of the compressor 133, a discharge pressure value at the output of the compressor 133. The controller 1020 is further adapted for directly instructing the compressor 133 and the fan 135.

The controller 1020 of the Control system 1000 executes the LPCOLASF 400 and the LPCOLASF modules 410-470. The Control system 1000 may execute one or several Modules 410-470 of the LPCOLASF 400, depending on the mode in which the condensing unit 130 is currently operating, and the conditions of operation of the condensing unit 130. When executing the Module(s) of the LPCOLASF 400, the controller 1020 performs the corresponding methods illustrated in FIGS. 5A-5D and 6-9. Although presented as FIGS. 5A-5D, the order in which these Modules may be executed by the controller 1020 may be performed in a different order.

Throughout the present specification, the acronyms LASP, LPCO, LPD and combined LPCO and LPD are being used as a name or as an epithet followed by the word 'value' interchangeably.

Any of the functionality of the LPCOLASF 400 and the LPCOLASF modules 410-470, described herein for the control system 1000, the controller 1020, etc. can be embodied in one more applications or firmware as described previously. According to some embodiments, "modules," "function," "functions," "application," "applications," "instruction," "instructions," or "programming" are program(s) that execute functions defined in the programs. Various programming languages can be employed to create one or more of the applications, structured in a variety of manners, such as object-oriented programming languages (e.g., Objective-C, Java, or C++) or procedural programming languages (e.g., C or assembly language).

In the examples above, the control system 1000, the controller 1020, etc. can each include a processor. As used herein, a processor is a hardware circuit having elements structured and arranged to perform one or more processing functions, typically various data processing functions. Although discrete logic components could be used, the examples utilize components forming a programmable central processing unit (CPU). A processor for example includes or is part of one or more integrated circuit (IC) chips incorporating the electronic elements to perform the functions of the CPU. The processors for example, may be based on any known or available microprocessor architecture, such as a Reduced Instruction Set Computing (RISC) using an ARM architecture. Of course, other processor circuitry may be used to form the CPU or processor hardware in. The illustrated examples of the processors can include one microprocessor or a multi-processor architecture. A digital signal processor (DSP) or field-programmable gate array (FPGA) could be suitable replacements for the processors, but may consume more power with added complexity.

The applicable processor executes programming or instructions to configure the control system 1000, the controller 1020, etc. to perform various operations. For example, such operations may include various general operations (e.g., a clock function, recording and logging operational status and/or failure information) as well as various system-specific operations functions. Although a processor may be configured by use of hardwired logic, typical processors are general processing circuits configured by execution of programming, e.g., instructions and any associated setting data from the memories shown or from other included storage media and/or received from remote storage media.

In the examples above, the control system 1000, the controller 1020, etc. each include a memory 1030. The memory 1030 may include a flash memory (non-volatile or persistent storage), a read-only memory (ROM), and a random access memory (RAM) (volatile storage). The RAM serves as short term storage for instructions and data being handled by the processors e.g., as a working data processing memory. The flash memory typically provides longer term storage.

Of course, other storage devices or configurations may be added to or substituted for those in the example. Such other storage devices may be implemented using any type of storage medium having computer or processor readable instructions or programming stored therein and may include, for example, any or all of the tangible memory of the computers, processors or the like, or associated modules.

Hence, a machine-readable medium or a computer-readable medium may take many forms of tangible storage medium. Non-volatile storage media include, for example, optical or magnetic disks, such as any of the storage devices in any computer(s) or the like, such as may be used to implement the client device, media gateway, transcoder, etc. shown in the drawings. Volatile storage media include dynamic memory, such as main memory of such a computer platform. Tangible transmission media include coaxial cables; copper wire and fiber optics, including the wires that comprise a bus within a computer system. Carrier-wave transmission media may take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards, paper tape, any other physical storage medium with patterns of holes, a RAM, a PROM and EPROM, a FLASH-EPROM, any other memory chip or cartridge, a carrier wave transporting data or instructions, cables or links transporting such a carrier wave, or any other medium from which a computer may read programming code and/or data. Many of these forms of computer readable media may be involved in carrying one or more sequences of one or more instructions to a processor for execution.

According to exemplary embodiments of the present disclosure the one or more processors and control circuits can include one or more of any known general purpose processor or integrated circuit such as a central processing unit (CPU), microprocessor, field programmable gate array (FPGA), Application Specific Integrated Circuit (ASIC), Digital Signal Processor (DSP), or other suitable programmable processing or computing device or circuit as desired that is specially programmed to perform operations for achieving the results of the exemplar embodiments described herein. The processor(s) can be configured to include and perform features of the exemplary embodiments of the present disclosure, such as the LPCOLASF 400 and the LPCOLASF modules 410-470. The features can be performed through program code encoded or recorded on the processor(s), or stored in a non-volatile memory device, such as Read-Only Memory (ROM), erasable programmable read-only memory (EPROM), or other suitable memory device or circuit as desired. Accordingly, such computer programs can represent controllers of the computing device.

In another exemplary embodiment, the program code, such as the LPCOLASF 400 and the LPCOLASF modules 410-470, can be provided in a computer program product having a non-transitory computer readable medium, such as Magnetic Storage Media (e.g. hard disks, floppy discs, or magnetic tape), optical media (e.g., any type of compact disc (CD), or any type of digital video disc (DVD), or other compatible non-volatile memory device as desired) and downloaded to the processor(s) for execution as desired, when the non-transitory computer readable medium is placed in communicable contact with the processor(s).

The one or more processors can be included in a computing system that is configured with components such as memory, a hard drive, an input/output (I/O) interface, a communication interface, a display and any other suitable component as desired. The exemplary computing device can also include a communications interface. The communications interface can be configured to allow software and data to be transferred between the computing device and external devices. Exemplary communications interfaces can include a modem, a network interface (e.g., an Ethernet card), a communications port, a PCMCIA slot and card, or any other suitable network communication interface as desired. Software and data transferred via the communications interface can be in the form of signals, which can be electronic, electromagnetic, optical, or other signals as will be apparent to persons having skill in the relevant art. The signals can travel via a communications path, which can be configured to carry the signals and can be implemented using wire, cable, fiber optics, a phone line, a cellular phone link, a radio frequency link, or any other suitable communication link as desired.

Where the present disclosure is implemented using programming or software, including the LPCOLASF 400 and the LPCOLASF modules 410-470, the programming or software can be stored in a computer program product or non-transitory computer readable medium and loaded into the computing device using a removable storage drive or communications interface. In an exemplary embodiment, any computing device, such as the control system 1000, the controller 1020, etc., disclosed herein can also include a display interface that outputs display signals to a display unit, e.g., LCD screen, plasma screen, LED screen, DLP screen, CRT screen, or any other suitable graphical interface as desired.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," "includes," "including," "has," "having," "containing," "contain", "contains," "with," "formed of," or any other variation thereof, are intended to cover a non-exclusive inclusion, such that a process, method, article, or apparatus that comprises or includes a list of elements or steps does not include only those elements or steps but may include other elements or steps not expressly listed or inherent to such process, method, article, or apparatus. An element preceded by "a" or "an" does not, without further constraints, preclude the existence of additional identical elements in the process, method, article, or apparatus that comprises the element. Unless otherwise stated, the articles "a" or "an" preceding an element mean one or more of the elements.

Unless otherwise stated, any and all measurements, values, ratings, positions, magnitudes, sizes, angles, and other specifications that are set forth in this specification, including in the claims that follow, are approximate, not exact. Such amounts are intended to have a reasonable range that is consistent with the functions to which they relate and with what is customary in the art to which they pertain. For example, unless expressly stated otherwise, a parameter value or the like may vary by as much as ±5% or as much as ±10% from the stated amount. The terms "approximately" and "substantially" mean that the parameter value or the like varies up to ±10% from the stated amount.

In addition, in the foregoing Detailed Description, it can be seen that various features are grouped together in various examples for the purpose of streamlining the disclosure. This method of disclosure is not to be interpreted as reflecting an intention that the claimed examples require more features than are expressly recited in each claim. Rather, as the following claims reflect, the subject matter to be protected lies in less than all features of any single disclosed example. Thus, the following claims are hereby incorporated into the Detailed Description, with each claim standing on its own as a separately claimed subject matter.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present concepts.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Although the present disclosure has been described hereinabove by way of non-restrictive, illustrative embodiments thereof, these embodiments may be modified at will within the scope of the appended claims without departing from the spirit and nature of the present disclosure.

What is claimed is:

1. A method for controlling a condensing unit, the method comprising:

verifying by a controller of the condensing unit if a suction pressure of a compressor of the condensing unit is below a Low Ambient Safety Pressure (LASP) value, and if the suction pressure is below the LASP, the controller executes a below LASP sub-module;

verifying by the controller of the condensing unit whether the suction pressure of the compressor of the condensing unit is above the LASP but below a Low Pressure Cut Out (LPCO), and if the suction pressure is above the LASP and below the LPCO, the controller executes a below LPCO sub-module;

verifying by the controller of the condensing unit whether the suction pressure of the compressor of the condensing unit is above the LASP, above the LPCO, and below a combined LPCO and Low Pressure Differential (LPD); and if the suction pressure is above the LASP, above the LPCO and below the combined LPCO and LPD, executing by the controller a below combined LPCO and LPD sub-module.

2. The method of claim 1, wherein the method starts by verifying that the compressor of the condensing unit is not in operation.

3. The method of claim 2, wherein the method further comprises verifying that an evaporator is in Cool mode.

4. The method of claim 1, wherein the below LASP value sub-module comprises:

turning off the compressor of the condensing unit for up to approximately fifteen minutes;

after up to approximately fifteen minutes, verifying if the suction pressure is above the LASP, and verifying whether the suction pressure remains above the LASP or above the LPCO.

5. A method for controlling operation of a condensing unit, the method comprising:

verifying by a controller of the condensing unit whether the condensing unit is in one of the following modes: a Cool mode, a System off mode, or a Compressor off mode;

if the condensing unit is in Cool mode, initiating by the controller a Low Pressure Cut Out in Low Ambient Start Function (LPCOLASF) Cool mode module, wherein the LPCOLASF Cool mode module includes:

verifying by the controller of the condensing unit whether the suction pressure of the compressor of the condensing unit is above a LASP (Low Ambient Safety Pressure), above a Low Pressure Cut Out (LPCO), and below a combined LPCO and Low Pressure Differential (LPD); and if the suction pressure is above the LASP, above the LPCO and below the combined LPCO and LPD, executing by the controller a below combined LPCO and LPD sub-module;

if the condensing unit is in System Off mode, initiating by the controller a Low Pressure Cut Out in Low Ambient Start Function (LPCOLASF) System Off mode module; and if the condensing unit is in Compressor off mode, initiating by the controller a Low Pressure Cut Out in Low Ambient Start Function (LPCOLASF) Compressor off mode module.

6. A system for controlling operation of a condensing unit in low ambient temperature conditions, the system comprising:

an input port for receiving a current suction pressure value at an input of a compressor of the condensing unit;

a controller for:

verifying if a suction pressure of the compressor of the condensing unit is below a Low Ambient Safety Pressure (LASP) value, and if the suction pressure is below the LASP, executing a below LASP sub-module;

verifying whether the suction pressure of the compressor of the condensing unit is above the LASP but below a Low Pressure Cut Out (LPCO), and if the suction pressure is above the LASP and below the LPCO, executing a below LPCO sub-module;

verifying whether the suction pressure of the compressor of the condensing unit is above the LASP, above the LPCO, and below a combined LPCO and Low Pressure Differential (LPD); and if the suction pressure is above the LASP, above the LPCO and below the combined LPCO and LPD, executing a below combined LPCO and LPD sub-module.

7. The system of claim 6, wherein the controller is configured to start by verifying that the compressor of the condensing unit is not in operation.

8. The system of claim 7, wherein the controller is further configured to verify that an evaporator is in Cool mode.

9. The system of claim 6, wherein the below LASP value sub-module comprises:

turning off the compressor of the condensing unit for up to approximately fifteen minutes;

after up to approximately fifteen minutes, verifying if the suction pressure is above the LASP, and verifying whether the suction pressure remains above the LASP or above the LPCO.

10. A system for controlling operation of a condensing unit, the system comprising:

an input port for receiving a current suction pressure value at an input of a compressor of the condensing unit;

a controller for verifying if the condensing unit is in a Cool mode, and if the condensing unit is in Cool mode:

verifying if a suction pressure of the compressor of the condensing unit is below a Low Ambient Safety Pressure (LASP) value, and if the suction pressure is below the LASP, executing a below LASP sub-module;

verifying whether the suction pressure of the compressor of the condensing unit is above the LASP but below a Low Pressure Cut Out (LPCO), and if the suction pressure is above the LASP and below the LPCO, executing a below LPCO sub-module;

verifying whether the suction pressure of the compressor of the condensing unit is above the LASP and above the LPCO but below a combined LPCO and Low Pressure Differential (LPD); and if the suction pressure is above the LASP, above the LPCO but below the combined LPCO and LPD, executing a combined LPCO and LPD sub-module.

11. The system of claim 10, wherein the LASP sub-module, the LPCO sub-module and the combined LPCO and LPD sub-module comprise different steps and setpoints.

* * * * *